US007444943B2

(12) United States Patent
Sauerwald

(10) Patent No.: US 7,444,943 B2
(45) Date of Patent: Nov. 4, 2008

(54) MODEL TRAIN ENGINE HOISTING MECHANISM

(76) Inventor: David Sauerwald, 126 Hunt St., Durham, NC (US) 27701

( * ) Notice: Subject to any disclaimer, the term of this patent is extended or adjusted under 35 U.S.C. 154(b) by 59 days.

(21) Appl. No.: 11/698,090

(22) Filed: Jan. 26, 2007

(65) Prior Publication Data

US 2008/0178759 A1 Jul. 31, 2008

(51) Int. Cl.
*B61K 5/00* (2006.01)

(52) U.S. Cl. ..... 104/32.1; 104/DIG. 1

(58) Field of Classification Search ..... 104/27, 104/32.1, DIG. 1; 238/10 R, 10 A, 10 B, 238/10 C, 10 E; 105/1.4, 1.5
See application file for complete search history.

(56) References Cited

U.S. PATENT DOCUMENTS

| | | | | |
|---|---|---|---|---|
| 1,851,449 | A * | 3/1932 | Royal et al. | 254/2 R |
| 2,941,724 | A * | 6/1960 | Lutts, Sr. | 238/10 R |
| 4,049,131 | A * | 9/1977 | Schrader et al. | 414/139.9 |
| 6,769,365 | B1 * | 8/2004 | Ward | 104/26.1 |
| 2005/0183619 | A1 * | 8/2005 | Shah et al. | 104/32.1 |

* cited by examiner

*Primary Examiner*—Jerry Redman
*Assistant Examiner*—Jason C Smith

(57) ABSTRACT

The hoisting mechanism known as the Engine Jack is an apparatus that may be positioned between the rails of a section of model train track such that it provides support for a model train engine while maintaining electrical contact with the rails. The Engine Jack enables model train engines to operate while standing still, yet providing the illusion that the model train engine is on the track. This allows the model train engine to be either serviced or put on display while the model train engine is running.

12 Claims, 4 Drawing Sheets

Engine Jack Mechanical Diagram

Figure 1: Engine Jack Mechanical Diagram

MODEL TRAIN ENGINE HOISTING MECHANISM

BACKGROUND OF THE INVENTION

Model train engines are designed to move and to pull other cars along. However, some maintenance activities require a model train engine to be in fill operation while remaining stationary. Previous methods for holding a model train engine stationary while performing maintenance have required extraordinary methods to hoist the engine above the track while maintaining electrical connectivity with the track. These solutions have used various blocks of materials to support the weight of the engine while establishing a separate means for supplying electrical power to the engine. These solutions are proprietary to each individual system and user. In addition, each individual engine support system must be masked in some fashion to provide the illusion that the engine is still on the track while supported.

The present invention is a novel and elegant solution for allowing a model train engine to be fully operational while standing still, yet provide the illusion for all viewers that the engine is on the track. The present invention provides this functionality while also providing fill electrical connectivity to the track, yet allowing the engine to run for very long periods of time without any wheel friction. The invention, herein known as the Engine Jack, is also suitable for use with any diameter wheel or scale of model train engine. The Engine Jack thus provides a novel, non-obvious, scalable, and cost-effective solution for providing support and power connectivity to model train engines during maintenance or display operations.

SUMMARY OF THE INVENTION

Figure 1:
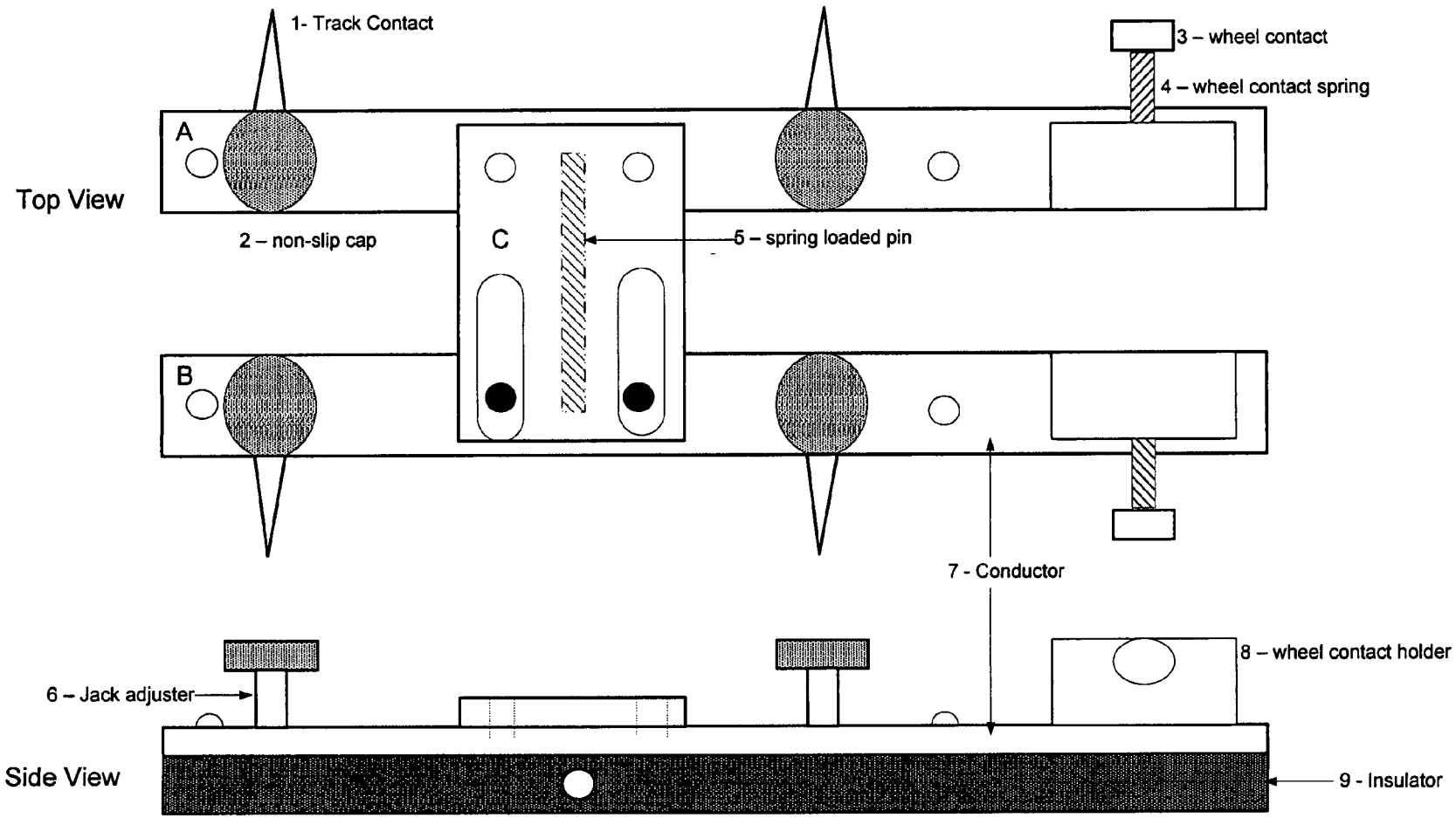
FIG. 1: Top and Side view of the Engine Jack

The engine hoist and connectivity mechanism of the current invention, herein known as the Engine Jack, provides a number of functions for the model train enthusiast. The Engine Jack, once inserted into the track of a model train setup, allows an enthusiast to put a model train engine on stationary display and yet allow the model train engine to function in full operation. This capability provides the enthusiast with the ability to perform service actions on a model train engine while in operation such as oiling the engine while running for better oil coverage, test and run engines after they have been serviced, operate and test all sound systems associated with an engine, and test lighted passenger cars and other lighting.

The instant invention consists of two slideably-attached, insulated support rails that have four track contact prongs, two on each rail, for maintaining contact with the model train track rails. On top of the insulated support rails are four model train engine supports, two on each rail, and two wheel contact holder supports, one on each rail. Each of the four engine supports is separately adjustable. On top of each of the four model engine supports is a non-slip, non-conductive cap that keeps the model train engine centered over the model train track and prevents the model train engine from slipping while resting upon the engine supports.

A spring loaded, adjustable wheel contact is perpendicularly mounted within each wheel contact support. The wheel contacts provide and maintain fill electrical connectivity between the model train tracks and the model engine through the Engine Jack rails. The wheel contacts are adjustable to provide full electrical connectivity with any model train engine that is supported by the Engine Jack regardless of the wheel diameter of the model train engine. The power connection to the model train engine from the model train track is thus provided by the wheel contacts.

The Engine Jack is designed such that the insulated rails may be squeezed together such that the Engine Jack may be inserted between the rails of the model train track. Once inserted, the track contact prongs, located on the outside of each of the Engine Jack support rails, exert pressure against the inside of the model track rails. This pressure establishes and maintains electrical connectivity with the model track rails, and holds the Engine Jack in place.

Once the Engine Jack has been inserted, the model train enthusiast may then adjust the train engine supports and the wheel contacts to suit the model train engine that is resting upon the Engine Jack.

DETAILED DESCRIPTION OF THE INVENTION

The instant invention is comprised of two support rails (A,B), a slideable cross mount C and cross mount spring pin 5, four track contact prongs 1, four adjustable engine support screws 6, four non-slip engine support screw caps 2, two wheel contact holders 8, two wheel contact springs 4, and two wheel contacts 3 assembled such that the completed assembly comprises a complete hoisting apparatus know as the Engine Jack. The Engine Jack may be manufactured for use with any scale of model trin, such as Z, N, HO, O, G, or any other scale in which model train engines are manufactured.

Each support rail (A,B) of the instant invention is composed of a rectangular non-conducting bottom block 9 mechanically connected to a conducting layer of any suitable electrically conductive material such that the conducting material layer is on top of the non-conducting block material 9 when the Engine Jack is oriented and positioned properly between two model train track rails. In the preferred embodiment, the electrically conductive material layer is composed of a metallic alloy. The conducting material layer is substantially the same length and width as the non-conducting bottom block material, with the addition of track contact prongs 1. Each conducting material layer has two track contact prongs 1, one at the end of the conducting material layer and one two-thirds of the distance between the first contact prong 1 and the opposite end of the support rail (A,B), oriented such that the two track contact prongs 1 are each in mechanical and electrical contact with the model train track when the Engine Jack is positioned between the model train track rails.

The Engine Jack support rails (A,B) are positioned parallel to one another and are adjustably connected by a cross mount C that is fastened perpendicularly to the Engine Jack support rails (A,B). One end of the cross mount C is fixedly fastened to a first Engine Jack support rail B through the use of two screws. The other end of the cross mount C is fastened to the second support rail A using two screws that are emplaced into the second support rail A through open slots in the cross mount C that provide for sufficient travel to allow the Engine Jack support rails (A,B) to be pressed together until they are substantially in physical contact. A spring pin S is positioned with each end of the pin set within a hole drilled within the non-conductive block portion 9 of the rails (A,B), directly under the cross mount C assembly. A spring is positioned with the pin such that the spring is directly between the two Engine Jack support rails (A,B) such that the spring pin S holds the support rails (A,B) apart during normal use of the Engine Jack. When the Engine Jack support rails (A,B) are compressed together through an action such as a squeeze motion, the spring resists the squeeze motion that moves the Engine Jack support rails (A,B) toward one another, and is of sufficient force to move the Engine Jack support rails (A,B) apart and maintain contact with the train track rails of a model train track when released. When properly inserted between the rails of a model train track the spring pin 5 provides sufficient force to maintain mechanical and electrical contact between the track contact prongs 1 of the Engine Jack and the model train track rails.

With the Engine Jack properly positioned between the model train track rails, the engine support screws 6 may be adjusted by turning each engine support screw 6 individually. Rotating the engine support screw 6 in a clockwise direction lowers the engine support screw 6, and rotating the engine support screw 6 in a counter-clockwise direction raises each engine support screw 6. In this fashion, the engine support screws 6 may be raised or lowered to accommodate individual differences for each engine the Engine Jack is required to support, including enabling use with model train engines that have different diameter wheels. The Engine Jack may thus not only accommodate different engines at different times on the same apparatus as well as different wheel diameters, but may also be customized to support engines that have non-standard or custom chasses.

The Engine Jack wheel contacts 3 are positioned such that they make contact with the interior surface of the wheels of any model train engine that is positioned on the Engine Jack. The Engine Jack wheel contacts 3 utilize wheel contact springs 4 to hold the wheel contacts 3 firmly against the model train engine wheels, and automatically adjust to any wheel spacing, accommodate different wheel diameters, and different model train engine types. The Engine Jack wheel contacts 3 are spring mounted into the wheel contact holders 8 perpendicular to the Engine Jack rails such that rotating the wheel contacts 3 in a counter-clockwise direction moves the head of the wheel contact 3 toward the wheel contact holders 8, and rotating the wheel contacts 3 in a clockwise direction moves the head of the wheel contacts 3 away from the wheel contact holders 8. In this fashion, the shaft of the wheel contact 3 is shortened or lengthened to conform to the wheel base of a variety of model train engines allowing the Engine Jack to accommodate a wide variety of model train engines. The wheel contact springs 4 also serve to hold the springs against the wheels of a model train engine even when the wheels of the model train engine are out of alignment.

Each Engine Jack support screw 6 is capped by a non-slip, non-conductive cap 2. The non-slip cap 2 may be manufactured from any material, such as rubber, plastic, composite, or any other material that is non-conductive and can support the weight of a model train engine without undue deformation. In the current embodiment, the Engine Jack non-slip caps 2 are manufactured from a rubber material that does not deform more than 5% under load, and provides sufficient friction to prevent any motion of a model train engine placed upon the Engine Jack when the Engine Jack is properly positioned.

Figure 2:
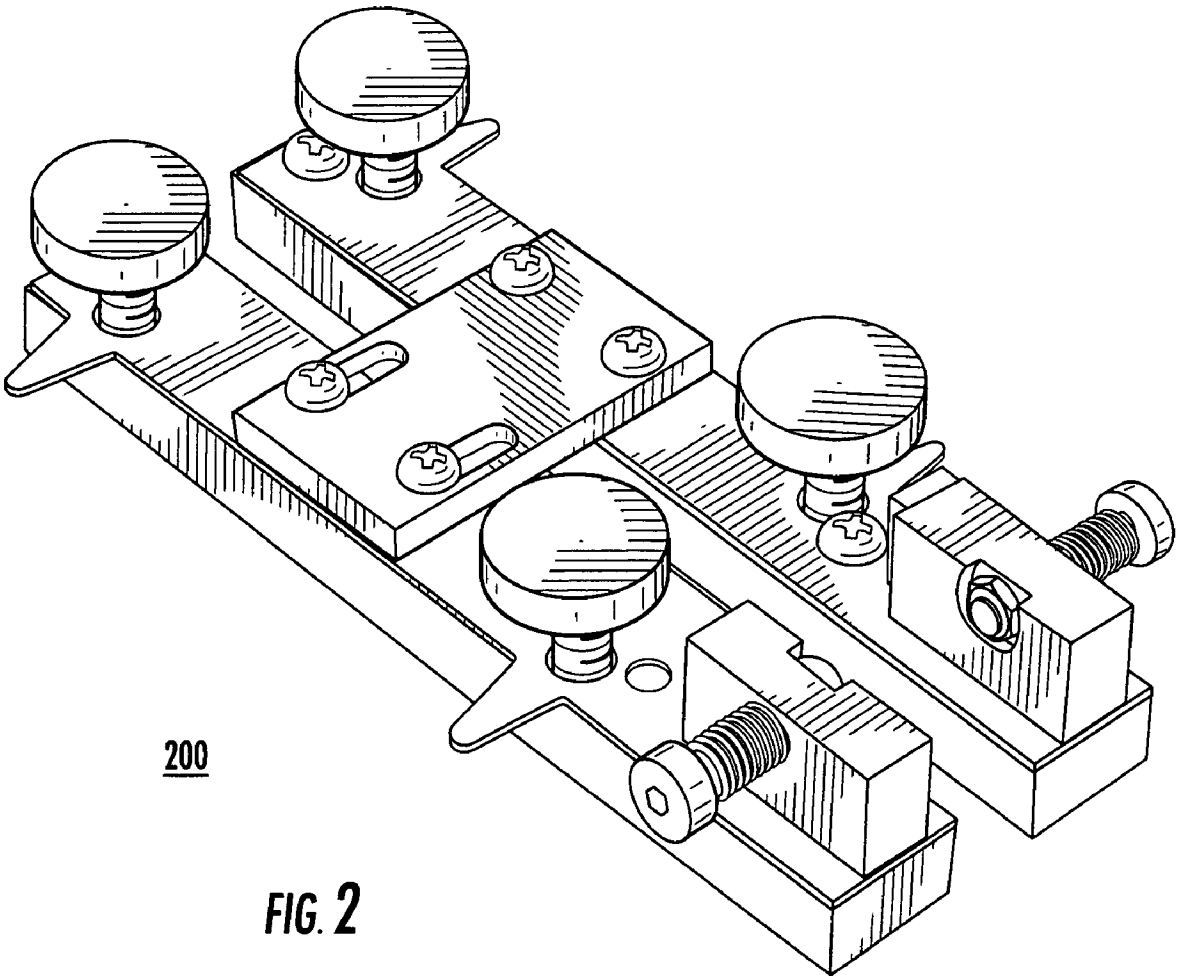
FIG. 2: Engine Jack separate from track
Figure 3:
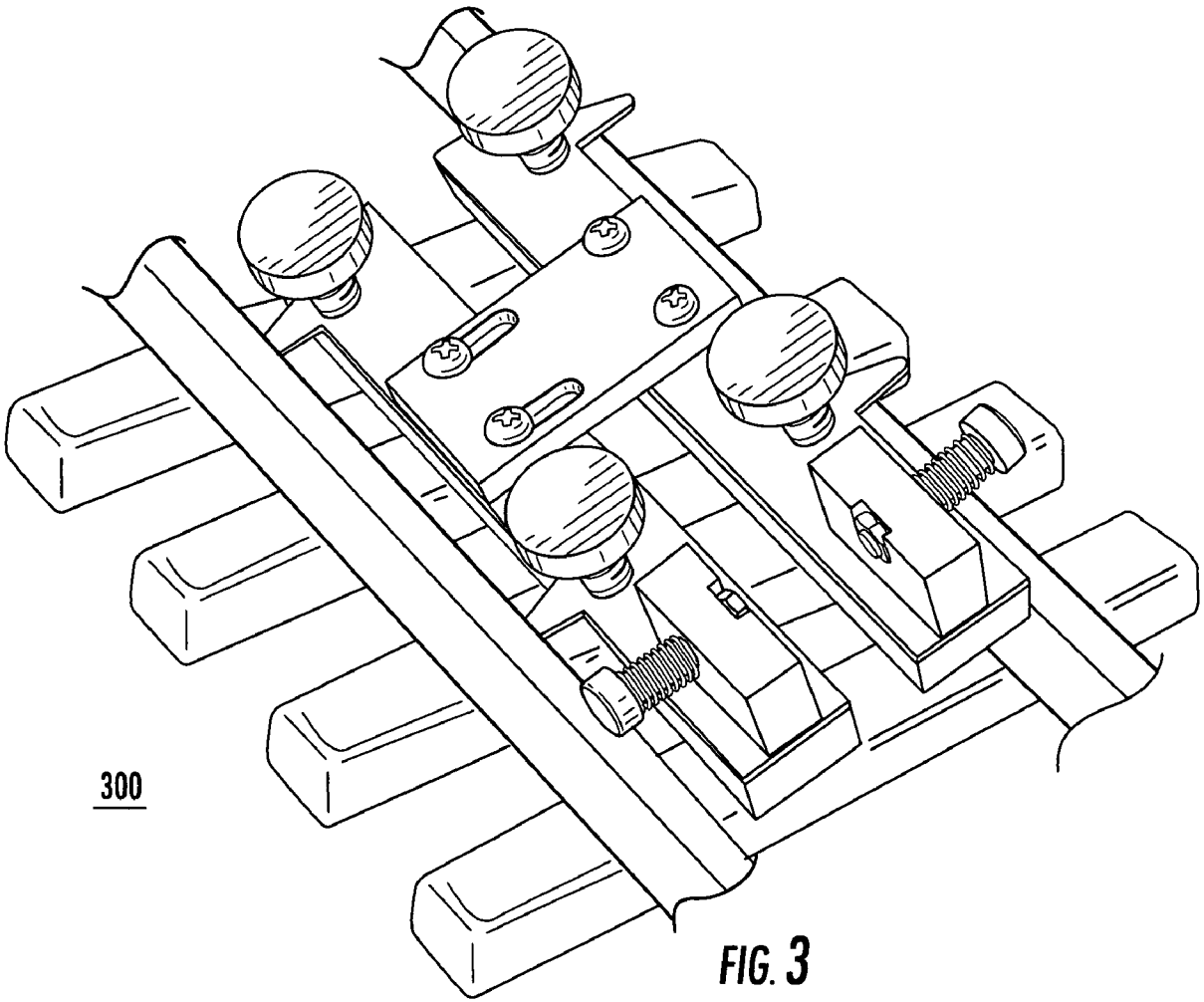
FIG. 3: Engine Jack during insertion to track
Figure 4:
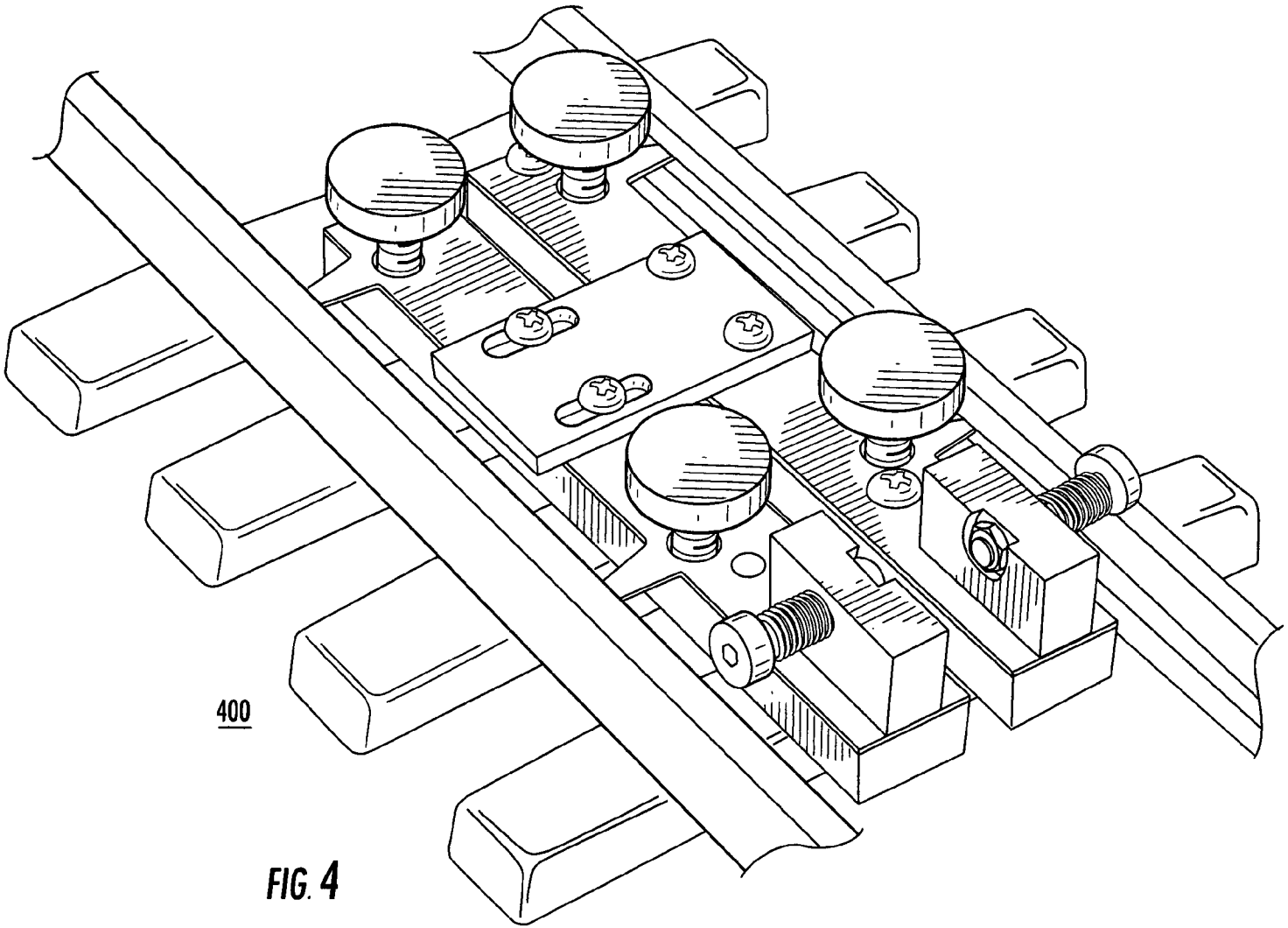
FIG. 4: Engine Jack fully inserted into track

In operation, the Engine Jack (FIG. 2) is grasped firmly by the thumb and forefinger. The user then applies enough compressive pressure to move the parallel Engine Jack rails toward one another and slip two of the track contacts in between the two model train tracks (FIG. 3). After lowering the Engine Jack such that the Engine Jack rails are positioned in-between and parallel with the two model train tracks, the user releases the Engine Jack. The Engine Jack is now positioned within the model train tracks and ready to support a model train engine and provide electrical contact between the model train engine and the model train track (FIG. 4).

While this invention has been particularly show and described with reference to preferred embodiments thereof, it will be understood by those skilled in the art that various changes in form and details may be made therein without departing from the spirit and scope of the invention as defined by the appended claims.

I claim:

1. An apparatus installed between the rails of a model train track to suspend a model train engine over said track and maintain electrical connectivity to enable a model train engine to operate while stationary comprising:

Two slideably attached support rails with rail contact prongs;

A slideable cross mount attached to said support rails;

A cross mount spring pin attached to said support rails;

Four adjustable engine support jack screws;

Four engine support screw caps;

Two wheel contact holders;

Two wheel contact springs;

Two wheel contacts;

Wherein said slideably attached support rails are set in parallel and are adjustably connected by said cross mount that is fastened perpendicularly to said rails;

And wherein said engine support jack screws are positioned to extend vertically from the upper surface of said support rails;

And wherein said wheel contact holders extend vertically from one end of said support rails such that said wheel contact springs and said wheel contacts are positioned to extend perpendicularly from said wheel contact holders so as to maintain contact with the wheels of any model train engine placed upon said apparatus;

The apparatus so configured as to support any model train engine in suspension over said model train track while simultaneously maintaining electrical contact between said model train engine and said model train track.

2. An apparatus as recited in claim 1 installed between the rails of a model train track to suspend a model train engine over said track and maintain electrical connectivity to enable a model train engine to operate while stationary further comprising:

Said slideable cross mount is mechanically fixed to a first support rail at one end of said cross mount;

Said slideable cross mount is mechanically fixed to a second support rail at the distal end of said cross mount through open slots in said cross mount to provide said support rails to move toward and away from one another when pressure is applied.

3. An apparatus as recited in claim 1 installed between the rails of a model train track to suspend a model train engine over said track and maintain electrical connectivity to enable a model train engine to operate while stationary further comprising:

Said spring pin comprises a metallic pin and a spring through which said pin is inserted;

Said spring pin is inserted into spring pin holes;

A first support rail and a second support rail in parallel each contain a spring pin hole aligned such that when said spring pin is inserted into said spring pin holes, said spring is perpendicular to said first and second support rails and first and second support rails are held apart by tension of said spring;

Wherein said spring pin is configured to hold the rail contact prongs in tension against the rails of a model train track when the apparatus is properly inserted between the rails of said model train track.

4. An apparatus as recited in claim 1 installed between the rails of a model train track to suspend a model train engine over said track and maintain electrical connectivity to enable a model train engine to operate while stationary further comprising:

Each support rail comprises a rectangular non-conducting bottom block mechanically connected to a rectangular layer of substantially the same shape comprising an electrically conductive material;

Said electrically conductive material is mechanically fastened on top of said non-conducting material when the apparatus is oriented and positioned properly between two model train tracks.

5. An apparatus as recited in claim 4 installed between the rails of a model train track to suspend a model train engine over said track and maintain electrical connectivity to enable a model train engine to operate while stationary further comprising:

Said electrically conductive material layer further comprises two model train track rail contact prongs;

A first prong extends horizontally from one end of said conductive material layer, and a second prong extends horizontally from a position two thirds of the distance between said first contact prong and the distal end of said conductive material layer;

Said prongs extend horizontally from said electrically conductive material rail layer toward said model train track rail when said apparatus is positioned properly between two parallel model train track rails such that they are in mechanical and electrical contact with said model train track rails.

6. An apparatus as recited in claim 1 installed between the rails of a model train track to suspend a model train engine over said track and maintain electrical connectivity to enable a model train engine to operate while stationary further comprising:

A first and a second rail of said apparatus each contain two engine support jack screws;

Said engine support jack screws extend vertically from upper surface of said rails;

The height of said engine support jack screws from the surface of said first and second rail is adjustable.

7. An apparatus as recited in claim 6 installed between the rails of a model train track to suspend a model train engine over said track and maintain electrical connectivity to enable a model train engine to operate while stationary further comprising:

Turning said engine support jack screw in a clockwise direction increases the height of said engine support jack screw, and turning said engine support jack screw in a counter-clockwise direction decreases the height of said engine support jack screw;

Wherein modifying the height of said engine support jack screws allows said apparatus to maintain suspension above the model train track rails and electrical connectivity with a plurality of model train engine types.

8. An apparatus as recited in claim 6 installed between the rails of a model train track to suspend a model train engine over said track and maintain electrical connectivity to enable a model train engine to operate while stationary further comprising:

Each engine support jack screw top is covered by an engine support jack screw cap.

9. An apparatus as recited in claim 8 installed between the rails of a model train track to suspend a model train engine over said track and maintain electrical connectivity to enable a model train engine to operate while stationary further comprising:

Said engine support jack screw cap is composed of a material that is non-conductive.

10. An apparatus as recited in claim 9 installed between the rails of a model train track to suspend a model train engine over said track and maintain electrical connectivity to enable a model train engine to operate while stationary further comprising:

Said engine support jack screw cap material is sufficient to support the weight of any model train engine placed upon said engine support jack screws without deforming more than 5% from original height of the engine support jack screw cap;

Wherein said engine support jack screw cap material is non-slip, thus maintaining said model train engine in a stationary position as supported by said engine support jack screws.

11. An apparatus as recited in claim 1 installed between the rails of a model train track to suspend a model train engine over said track and maintain electrical connectivity to enable a model train engine to operate while stationary further comprising:

Said wheel contacts, wheel contact holders, and wheel contact springs are composed of electrically conductive material.

12. An apparatus as recited in claim 1 installed between the rails of a model train track to suspend a model train engine over said track and maintain electrical connectivity to enable a model train engine to operate while stationary further comprising:

Said apparatus is manufactured for use with any scale of model train, such as Z, N, HO, O, G, or any other scale in which model train engines are manufactured.

* * * * *